US006170764B1

(12) United States Patent
Müller et al.

(10) Patent No.: US 6,170,764 B1
(45) Date of Patent: Jan. 9, 2001

(54) FUEL INJECTION VALVE

(75) Inventors: Martin Müller, Möglingen; Günter Dantes, Eberdingen; Jörg Heyse, Markgröningen, all of (DE)

(73) Assignee: Robert Bosch GmbH, Stuttgart (DE)

( * ) Notice: Under 35 U.S.C. 154(b), the term of this patent shall be extended for 0 days.

(21) Appl. No.: 09/445,518

(22) PCT Filed: Jan. 14, 1999

(86) PCT No.: PCT/DE99/00049

§ 371 Date: Dec. 7, 1999

§ 102(e) Date: Dec. 7, 1999

(87) PCT Pub. No.: WO99/53192

PCT Pub. Date: Oct. 21, 1999

(30) Foreign Application Priority Data

Apr. 8, 1998 (DE) ..... 198 15 781

(51) Int. Cl.[7] ..... F02M 61/00

(52) U.S. Cl. ..... 239/533.12; 239/491; 239/494; 239/584; 239/585.1; 239/590; 239/596

(58) Field of Search ..... 239/491, 494, 239/496, 497, 533.12, 584, 585.1, 585.4, 585.5, 590, 590.3, 596, DIG. 19

(56) References Cited

U.S. PATENT DOCUMENTS 4,040,396 8/1977 Hitoshi .
5,484,108 * 1/1996 Nally ..... 239/585.4 X
5,685,491 * 11/1997 Marks et al. ..... 239/596 X
5,766,441 * 6/1998 Arndt et al. ..... 239/596 X
5,899,390 * 5/1999 Arndt et al. ..... 239/585.1 X
5,921,474 * 7/1999 Zimmermann et al. ..... 239/596 X
5,924,634 * 7/1999 Arndt et al. ..... 239/596 X
6,050,507 * 4/2000 Holzgrefe et al. ..... 239/585.1

FOREIGN PATENT DOCUMENTS 39 43 005 7/1990 (DE) .
196 07 277 10/1996 (DE) .
196 07 288 10/1996 (DE) .
96 11335 4/1996 (WO) .

* cited by examiner

*Primary Examiner*—Andres Kashnikow
*Assistant Examiner*—Steven J. Ganey
(74) *Attorney, Agent, or Firm*—Kenyon & Kenyon

(57) ABSTRACT

A fuel injection valve having a swirl disk, located downstream from a valve seat (15), that is made of at least one metallic material and has at least two swirl channels emptying into a swirl chamber, with all layers being built up by electrodeposition (multilayer electroplating) so that they adhere firmly to each other. The swirl disk has an upper layer that includes multiple material areas separated from each other by opening structures. The material areas of the swirl disk rest against a valve seat body containing the valve seat. The fuel injection valve is especially suitable for injecting fuel directly into the combustion chamber of a mixture-compressing internal combustion engine with externally supplied ignition.

10 Claims, 5 Drawing Sheets

FUEL INJECTION VALVE

FIELD OF THE INVENTION

The present invention relates to a fuel injection valve.

BACKGROUND INFORMATION

An electromagnetically operated fuel injection valve having multiple disk-shaped elements arranged in its seat area is described in German Patent No. 39 43 005. Upon excitation of a magnetic circuit, a flat valve plate acting as a flat armature lifts up from a valve seat plate situated opposite and interacting with the valve plate, together forming a plate valve part. A swirl element, which sets the fuel flowing to the valve seat in a circular rotary motion, is located upstream from the valve seat plate. A stop plate limits the axial displacement of the valve plate on the side opposite the valve seat plate. The swirl element surrounds the valve plate, leaving a large amount of clearance; the swirl element thus guides the valve plate to a certain degree. At the lower end of the swirl element several tangential grooves provided that begin at the outer circumference and extend all the way to a central swirl chamber. When the lower end of the swirl element lies against the valve seat plate, the grooves become swirl channels.

A fuel injection valve having a multi-disk atomizing attachment with a swirl conditioning element located at its downstream end is described in International Patent Publication No. WO 96/11335. This atomizing attachment is provided downstream from a disk-shaped guide element built into a valve seat carrier and from a valve seat also located on the valve carrier, with an additional supporting element holding the atomizing attachment in a defined position. The atomizing attachment is designed in two-disk and four-disk versions, with the individual disks being made of stainless steel or silicon. Likewise, conventional machining methods such as erosion, punching, and etching are used in producing the geometries of the openings in the disks. Each individual disk of the atomizing attachment is produced separately, after which all disks of the same size are stacked on top of one another to form the complete atomizing attachment, depending on the desired number of disks.

The multilayer electroplating method for producing perforated disks that are especially well suited for use in fuel injection valves have been described in detail in German Patent Application No. 196 07 288. This principle for manufacturing disks by electrodepositing different structures in multiple layers, thus forming a one-piece disk, is expressly included in the content of the disclosure of the present invention. Microelectroplating in layers, strata and levels is also used for producing the atomizer disks used here and installed according to the present invention.

SUMMARY OF THE INVENTION

The fuel injection valve according to the present invention has the advantage that it can be used to achieve a very high atomization quality of a fuel to be injected as well as a highly variable jet or spray pattern that can be adapted to the relevant requirements (such as mounting arrangements, engine configurations, cylinder shapes, and spark plug position). Consequently, the use of atomizer disks that can be very easily inserted into the fuel injection valve makes it possible, among other things, to reduce the exhaust emissions of internal combustion engines equipped with fuel injection valves of this type and also to lower fuel consumption.

The atomizer disk is produced in a very advantageous manner by multilayer electroplating. Because they are made of metal, the atomizer disks are highly resistant to breaking, can be easily mounted, and, because of the specific design of their topmost layer, can be easily attached to the fuel injection valve. Mounting the atomizer disk in a precisely defined position on the fuel injection valve has been especially simplified. The use of multilayer electroplating permits a very large amount of design flexibility because the contours of the opening areas (inlet areas, inflow areas, swirl channels, and swirl chamber) in the atomizer disk can be freely selected. Particularly in comparison with the production of silicon disks, whose contours are strictly limited due to the crystallographic axes (truncated pyramids), this flexible design capability is advantageous.

Electrodeposition has the advantage, particularly in comparison to the production of silicon disks, that a wide variety of materials can be used. The many different metals with their various magnetic characteristics and hardnesses can be used in the microelectroplating method employed to produce the atomizer disks.

It is advantageous to design the atomizer disk in the form of a swirl disk. It is particularly advantageous to construct the swirl disk, which includes three layers, by performing three electroplating steps. The upstream layer forms a spacing layer, which is followed, in the downstream direction, by an inflow layer that completely covers the swirl chamber of a lower swirling layer. The swirling layer is formed by one or more areas of material that are shaped and positioned geometrically toward one another so that they define the contours of the swirl chamber and swirl channels. The electroplating process deposits the individual layers onto one another without any seams or joints so that they form a continuous, homogeneous material. In this respect, the term "layers" serves only as a conceptual aid.

Two, three, four or six swirl channels are advantageously provided in the swirl disk. The material areas can have very different shapes, depending on the desired contours of the swirl channels; for example they can form a web or a spiral. The contours of the spacing layer and the swirl chamber can also advantageously have a flexible design.

To provide a simple attachment method, it is particularly advantageous to clamp the atomizer disk between the valve seat body of the valve and a holding element. The holding element is suitably designed in the shape of a cup and has a circumferential jacket section and a base section. While the base section supports the atomizer disk and allows the disk to be pressed against the valve seat body, the jacket section fixes the holding element in place on the valve seat body, for example via a weld seam.

Further advantages are explained in greater detail below in the description of the embodiments.

DETAILED DESCRIPTION

Figure 1:
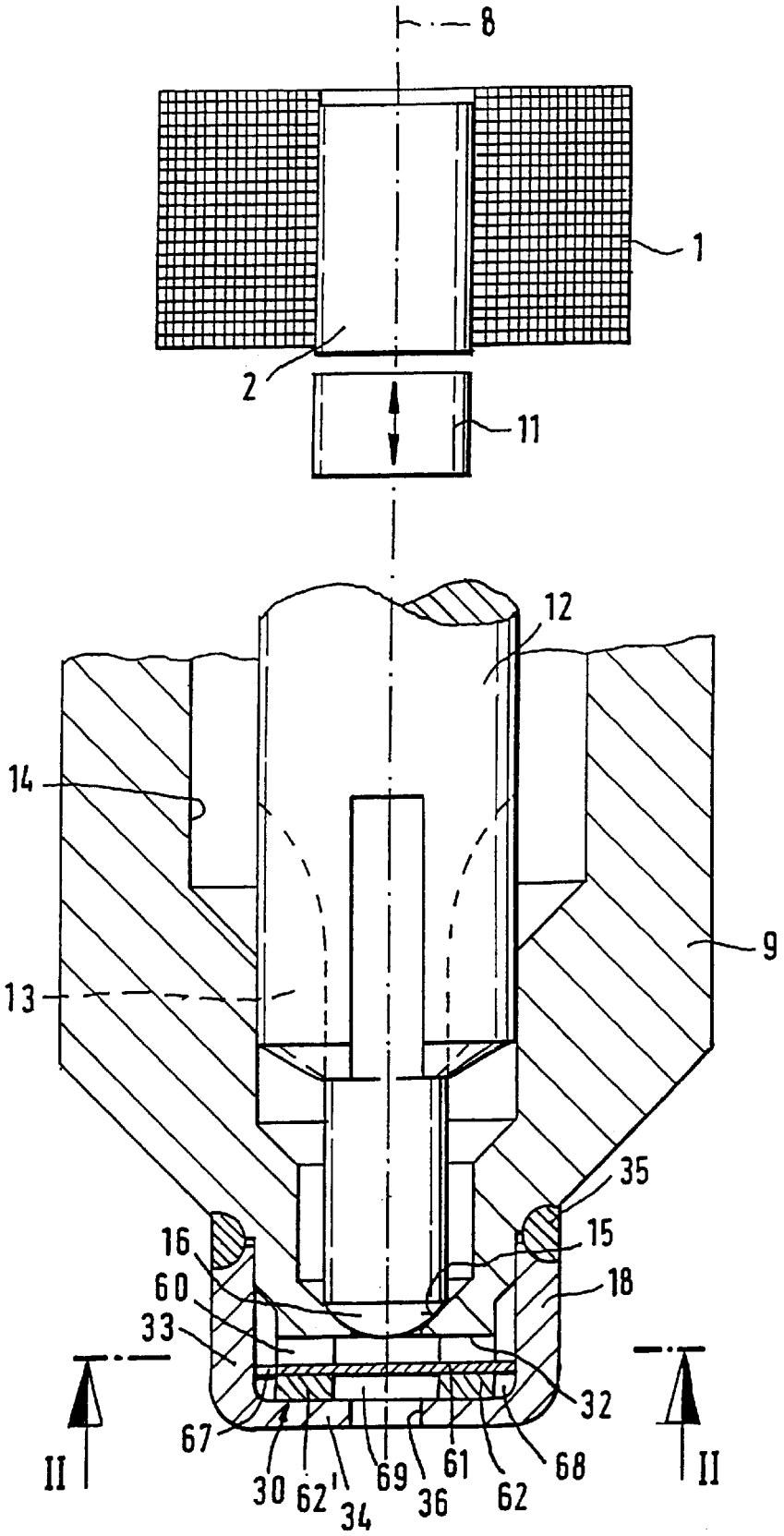
FIG. 1 shows a partial sectional representation of a first embodiment of a fuel injection valve with an atomizer disk positioned at the downstream end of the fuel injection valve.

The electromagnetically operated valve illustrated in a simplified form as an example in FIG. 1 is an injection valve for fuel injection systems in mixture-compressing internal combustion engines with externally supplied ignition and has a tubular, largely hollow cylindrical core 2 serving as the inner pole of a magnetic circuit and at least partially surrounded by a solenoid 1. The fuel injection valve is suitable, in particular, for use as a high-pressure injection valve for injecting fuel directly into a combustion chamber of an internal combustion engine.

The valve extends along a longitudinal valve axis 8. A valve housing is formed, at least in part, by a longitudinal, multiple-stepped valve seat body 9 in which an axially moving valve part is provided. This valve part includes at least an armature 11 and a rod-shaped valve needle 12 that is surrounded by valve seat body 9. An inner passage 14 in valve seat body 9, which is positioned concentrically to longitudinal valve axis 8, is designed, for example, so that it is used, in part, to guide valve needle 12. Around the circumference of valve needle 12, in this example, four milled slots 13, which allow the stream to flow through the needle guiding area along valve seat body 9, are distributed. The valve part can also be designed as a flat disk with an integrated armature.

The lower end of passage 14 is tapered in the shape of a truncated cone in the downstream direction because valve seat body 9 forms a conical valve seat surface 15 in this region. Valve needle 12 has a valve closing segment 16 at its downstream end. This valve seat segment 16, which has a rounded, semi-spherical shape, interacts with valve seat surface 15 in the coventional manner.

Downstream from valve seat surface 15 an atomizer disk 30 is provided according to the present invention. The atomizer disk 30 is held and fixed in place by a cup-shaped holding element 18, and due to its geometry and special function, is referred to as swirl disk 30 in the embodiments. Swirl disk 30 is produced, for example, by a multilayer electroplating process and includes three metal layers that are deposited upon one another.

The injection valve is operated in the conventional manner, for example, electromagnetically. The indicated electromagnetic circuit, containing solenoid 1, core 2, and armature 11, is used to move valve needle 12 in the axial direction, thus opening the injection valve against the force of a resetting spring (not illustrated) or closing the valve. Armature 11 is connected to the end of valve needle 12 facing away from valve closing segment 16, for example by a welded seam, and oriented toward core 2.

Instead of the electromagnetic circuit, a different excitable actuator, such as a piezostack, can be used in a comparable fuel injection valve, or the axially moving valve part can be operated by a hydraulic pressure or a servo pressure.

The stroke of valve needle 12 is defined, among other things, by valve seat surface 15. When solenoid 1 is not excited, one end position of valve needle 12 is established when valve closing segment 16 comes to rest against valve seat surface 15, while the other end position of valve needle 12 is established when armature 11 comes to rest against the downstream end of core 2 when solenoid 1 is excited. The surfaces of the components in the latter stop area are, for example, chromium-plated.

Holding element 18 limits the downstream end of the injection valve by forming a cap, thus providing good protection for the valve seat area. Holding element 18 also serves to hold swirl disk 30, which is pressed by holding element 18 against lower end 32 of valve seat body 9. Holding element 18 is, for example, a flat metal body with a jacket section 33 surrounding it in a circumferential direction and a base section 34, which forms the actual end of the valve. Jacket section 33 is permanently connected to valve seat body 9, for example, by a circumferential weld seam 35 produced by a laser. Swirl disk 30 rests against the inner limiting side of base section 34. Base section 34 has a central discharge opening 36, which is produced, for example, by punching and through which the now swirling fuel leaves the fuel injection valve.

Figure 2:
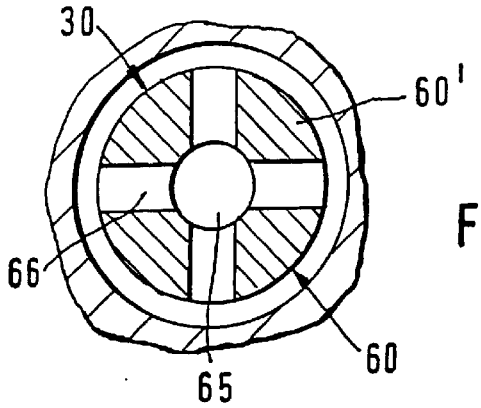
FIG. 2 shows a sectional view along line II—II shown in FIG. 1.

FIG. 2 shows a sectional view along line II—II in FIG. 1 of top layer 60 of swirl disk 30. A swirl disk 30 of this type is a one-piece component because the individual layers are electrodeposited directly upon each other rather than being joined together later on. The subsequent layer adheres firmly to the underlying layer due to electrical adhesion.

In this case, swirl disk 30 is formed from three consecutively deposited levels, strata or layers which thus follow each other directly in the direction of flow after the device is mounted. The three layers of swirl disk 30 are referred to below as spacing layer 60, inflow layer 61, and swirling layer 62, according to their functions. Spacing layer 60 includes multiple material areas 60' which are spaced at a distance from each other in segments of a circle, for example. Material areas 60' establish the distance between the actual atomizer layers of swirl disk 30 and end 32 of valve seat body 9. Material areas 60' are a kind of "spacing web". Multiple channels 66, which are formed by the spaces between material areas 60', run from an inner opening area 65 to the outer edge of spacing layer 60. This ensures that the fuel can flow outward in spacing layer 60.

Middle inflow layer 61 has, for example, a slightly larger outer diameter than top layer 60, and the diameter of inflow layer 61 can be large enough so that it can fit snugly inside jacket section 33, preventing swirl disk 30 from slipping. The fuel emerges from channels 66 into outer flow openings 67 (FIG. 1) of inflow layer 61, which is otherwise made of solid metal without any openings.

From there, the fuel freely enters external inlet areas 68 of swirling layer 62, to which are joined multiple swirl channels (not illustrated) which, in turn, empty tangentially into a central swirl chamber 69 that is covered on top by inflow layer 61. Swirling layer 62 is provided with a complex opening contour, which covers the entire axial thickness of this layer 62. Because the swirl channels empty tangentially into swirl chamber 69, an angular momentum is imparted on the fuel, which also retains this momentum in discharge opening 36 of base section 34. The contours of swirl chamber 69 and the swirl channels are defined by correspondingly deposited material areas 62' of swirling layer 62. Material areas 62' can be designed, for example, in the shape of a web, spiral, paddle wheel, or a similar form.

Swirl disk 30 is constructed from multiple metal layers by electrodeposition (multilayer electroplating). The production method using gravure lithography and electroplating provides special design features, some of which are summarized below:

layers having a constant thickness over the entire disk surface;

largely vertical incisions in the layers due to the gravure lithographic patterning, with these incisions forming the hollow spaces through which the liquid flows (production-related deviations of approximately 3° over perfectly vertical walls can occur);

desired recesses and coverings of the incisions due to the multilayer construction of individually patterned metal layers;

incisions with any cross-sectional shape having walls that run largely parallel to the axis;

one-piece design of the swirl disk, since the individual metal layers are deposited directly upon one another.

The following paragraphs provide a summary of the method for producing swirl disks 30. All electrodeposition process steps used in producing a perforated disk have already been explained in detail in German Patent Application No. 196 07 288. Characterisic of the method in which photolithographic steps (UV gravure lithography) are applied successively, followed by microelectroplating, is the fact that it guarantees a high level of structural precision even on a large scale, making it ideal for extremely high-volume mass production (large-batch capacity). A large number of swirl disks 30 can be produced simultaneously on a blank or wafer.

The method starts with an even and stable substrate, which can be made for example of metal (titanium, steel), silicon, glass, or ceramic. At least one optional auxiliary layer is then applied to the substrate. This can be, for example, an electroplated start layer (such as TiCuTi, CrCuCr or Ni) which is needed to provide electrical conduction for the later microelectroplating process. The auxiliary layer is applied, for example, by sputtering or de-energized metal deposition. After pretreating the substrate in this manner, a photoresist is applied to the entire surface of the auxiliary layer, for example by rolling or centrifuging.

The thickness of the photoresist should equal the thickness of the metal layer to be produced in the electroplating process that follows later on, i.e., it should equal the thickness of the lower swirling layer 62 of swirl disk 30. The resist layer may also include one or more strata of a photopatternable film or a liquid resist (polyimide or photoresist). If an optional sacrificial layer is to be electroplated into the resist patterns produced later on, the thickness of the photoresist must be increased by the thickness of the sacrificial layer. The metal pattern to be produced should be inversely transferred to the photoresist with the aid of a photolithographic mask. One way to do this is to expose the photoresist directly via the mask using UV exposure (p.c. board printer or a semiconductor printer and UV gravure lithography) and then develop it.

The final negative pattern produced in the photoresist for later layer 62 of swirl disk 30 is electrically filled with metal (e.g., Ni, NiCo, NiFe, NiW or Cu) by electrodeposition. The electroplating process lays the metal close to the contour of the negative structure, making it possible to reproduce the preset contours in a dimensionally accurate manner. To create the structure of swirl disk 30, the steps must be repeated from the optional application of the auxiliary layer, depending on the number of layers desired, carrying out three electroplating steps to produce one three-layer swirl disk 30. Different metals can also be used for the layers of a swirl disk 30, each one being applied in a new electroplating step.

After depositing upper spacing layer 60, the remaining photoresist is removed from the metal patterns by a wet chemical stripping process. In the case of smooth, passivated substrates, swirl disks 30 can be detached and separated from the substrate. If swirl disks 30 adhere firmly to the substrates, the sacrificial layer is etched away selectively from the substrate and swirl disk 30, making it possible to detach and separate swirl disks 30 from the substrate.

FIGS. 3 through 8 show further embodiments of the valve ends, containing swirl disks 30 and designed according to the present invention, whose fundamental design corresponds to the downstream valve end shown in FIG. 1. In the embodiments illustrated in the following figures, the components that are the same or perform the same function as in the embodiment shown in FIG. 1 are identified by the same reference numbers and are not explained in any further detail. The description below deals only with differences and special features.

Figure 3:
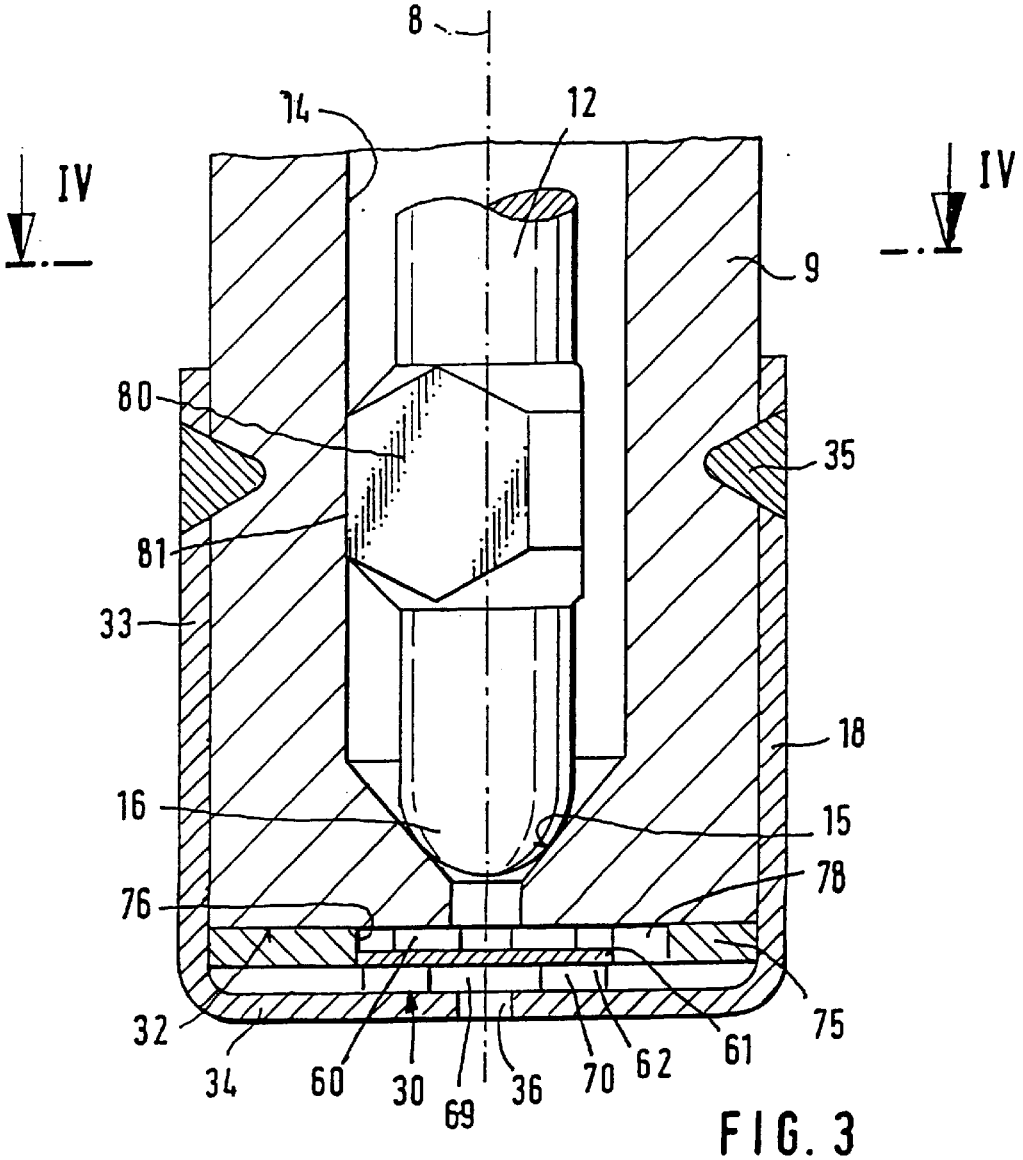
FIG. 3 shows a second embodiment of a downstream end of a fuel injection valve according to the present invention.

In the embodiment illustrated in FIG. 3, swirl disk 30 is inserted, at least in part, into a centering ring 75. Like upper spacing layer 60 of swirl disk 30, centering ring 75 also rests against lower end 32 of valve seat body 9. In centering ring 75 an inner circular opening 76 is provided, with middle layer 61 of swirl disk 30 fitting snugly inside. The outer diameter of layer 61 is identical to the inner diameter of opening 76, thus forming a solid metal layer without any opening areas. Instead, centering ring 75 has multiple recesses 78 extending outward from opening 76 across the circumference, allowing the fuel to flow into swirling layer 62. The sectional view in FIG. 3 was selected so that swirl channels 70 in swirling layer 62 can be seen.

Figure 4:
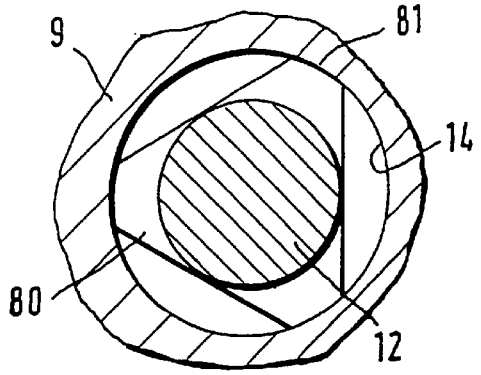
FIG. 4 shows a sectional view along line IV–IV shown in FIG. 3.

The sectional view shown in FIG. 4 along line IV—IV in FIG. 3 illustrates a further embodiment of valve needle 12. While the axially moving valve part is initially guided, for example, by armature 11, a guide segment 80 is provided to guide valve needle 12 downward in a second motion. Guide segment 80 is designed, for example, in the form of a triangle, with the three side edges extending over a certain area, thus forming three slightly curved guide surfaces 81 for guiding valve needle 12.

For direct gasoline injection, it is advantageous, for example, to have injection valves that spray the fuel at an angle in relation to longitudinal valve axis 8, due to certain mounting arrangements directly on the combustion chamber. In this case, for example, a swirling, possibly rotationally symmetrical hollow cone spray pattern is produced, with even distribution across the circumference of the hollow cone.

Figure 5:
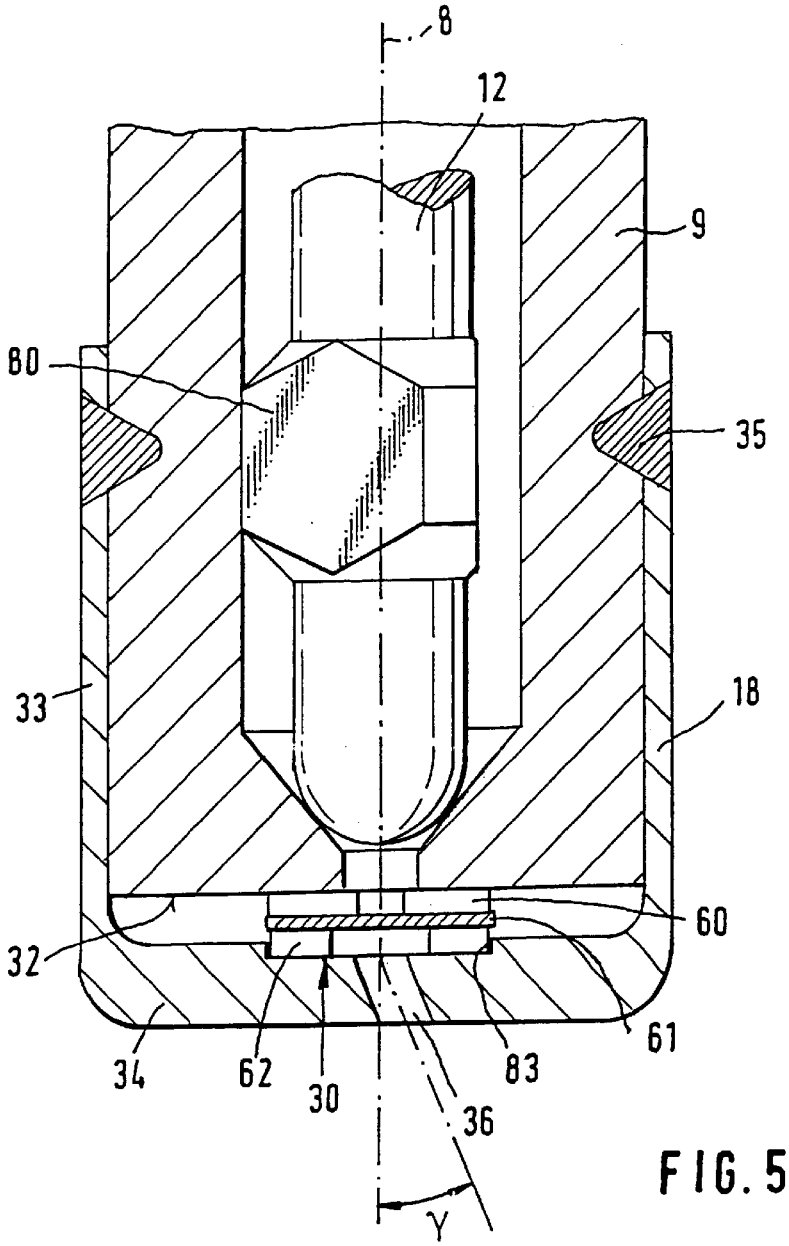
FIG. 5 shows a third embodiment of a downstream end of a fuel injection valve according to the present invention.

FIG. 5 shows one possible design variation in which a discharge opening 36 positioned at an angle to longitudinal valve axis 8 is provided in base section 34 of holding element 18. Discharge opening 36 begins, for example, in the middle of the inner limit side and supporting surface of swirl disk 30 and ends at the outer center of the lower end of the holding element, with the angle of inclination of discharge opening 36 determining the jet angle of the entire spray in relation to longitudinal valve axis 8. The jet orientation is identified by an arrow and the symbol $\gamma$, where $\gamma$ indicates the spray angle in relation to longitudinal value axis 8.

In this embodiment, a slight indentation 83, which can be produced by embossing, for example, is provided on the inner limit side of base section 34. Indentation 83 is designed with a diameter that allows lower swirling layer 62 and, in particular, material areas 62' of swirl disk 30 to fit snugly within the indentation. Indentation 83 centers swirl disk 30, eliminating the need for centering rings (FIG. 3) or a centering inflow layer 61 with flow openings 67 (FIG. 1).

Figure 6:
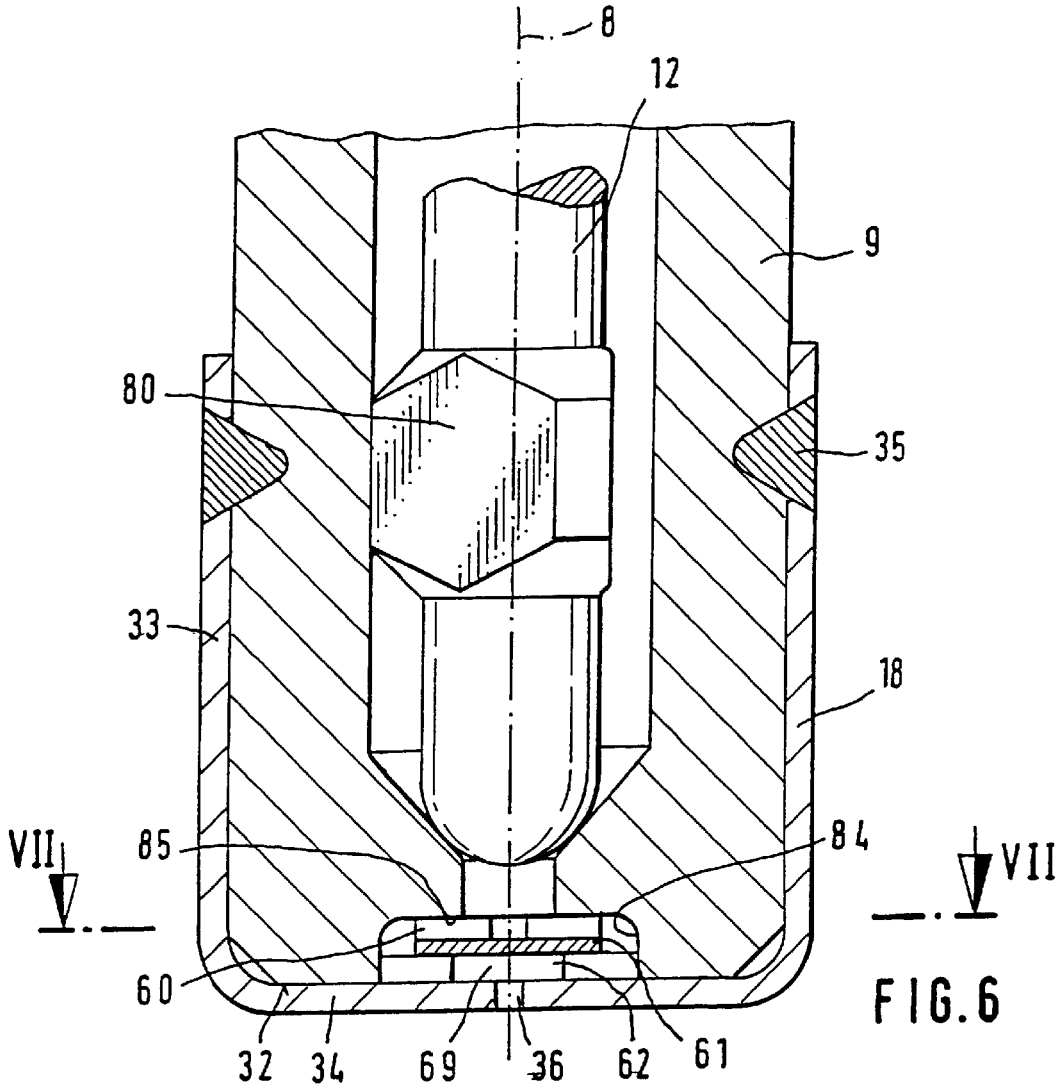
FIG. 6 shows a fourth embodiment of a downstream end of a fuel injection valve according to the present invention.

To some extent, the example illustrated in FIG. 6 is the direct opposite of the installation principle shown in FIG. 5 because it provides an indentation 84 in valve seat body 9 instead of indentation 83 in holding element 18. Indentation 84 is provided at lower end 32 of valve seat body 9 and is deep enough in relation to valve seat surface 15 so that swirl disk 30 disappears into it entirely after being mounted, which means that the depth of indentation 84 corresponds at least to the axial height or thickness of swirl disk 30. Base section 34 of holding element 18, for example, nestles directly against end 32. As a result, swirl disk 30, for example, rests on base section 34 as well as on a base 85 of indentation 84.

Figure 7:
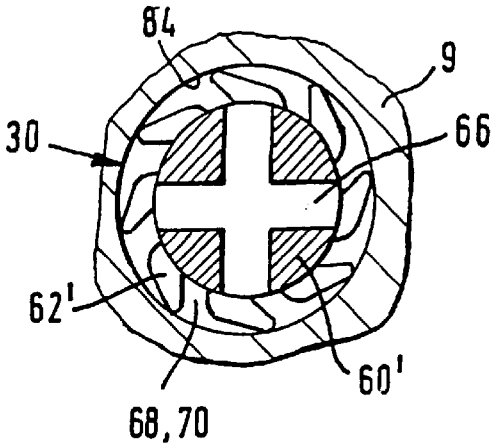
FIG. 7 shows a sectional view along line VII—VII shown in FIG. 6.

In FIG. 7, a sectional view along line VII—VII in FIG. 6 shows that both upper layers 60 and 61 of swirl disk 30 have smaller outer diameters than lower swirling layer 62. The fuel, which is flowing radially toward the outside through channels 66 in upper spacing layer 60, subsequently enters outer inlet areas 68 of lower swirling layer 62, from where the flow is directed through swirl channels 70. Material areas 62' of lower layer 62, which define the outer joint diameter of swirl disk 30, take the form of droplet-shaped vanes, defined by the contours of swirl channels 70.

Figure 8:
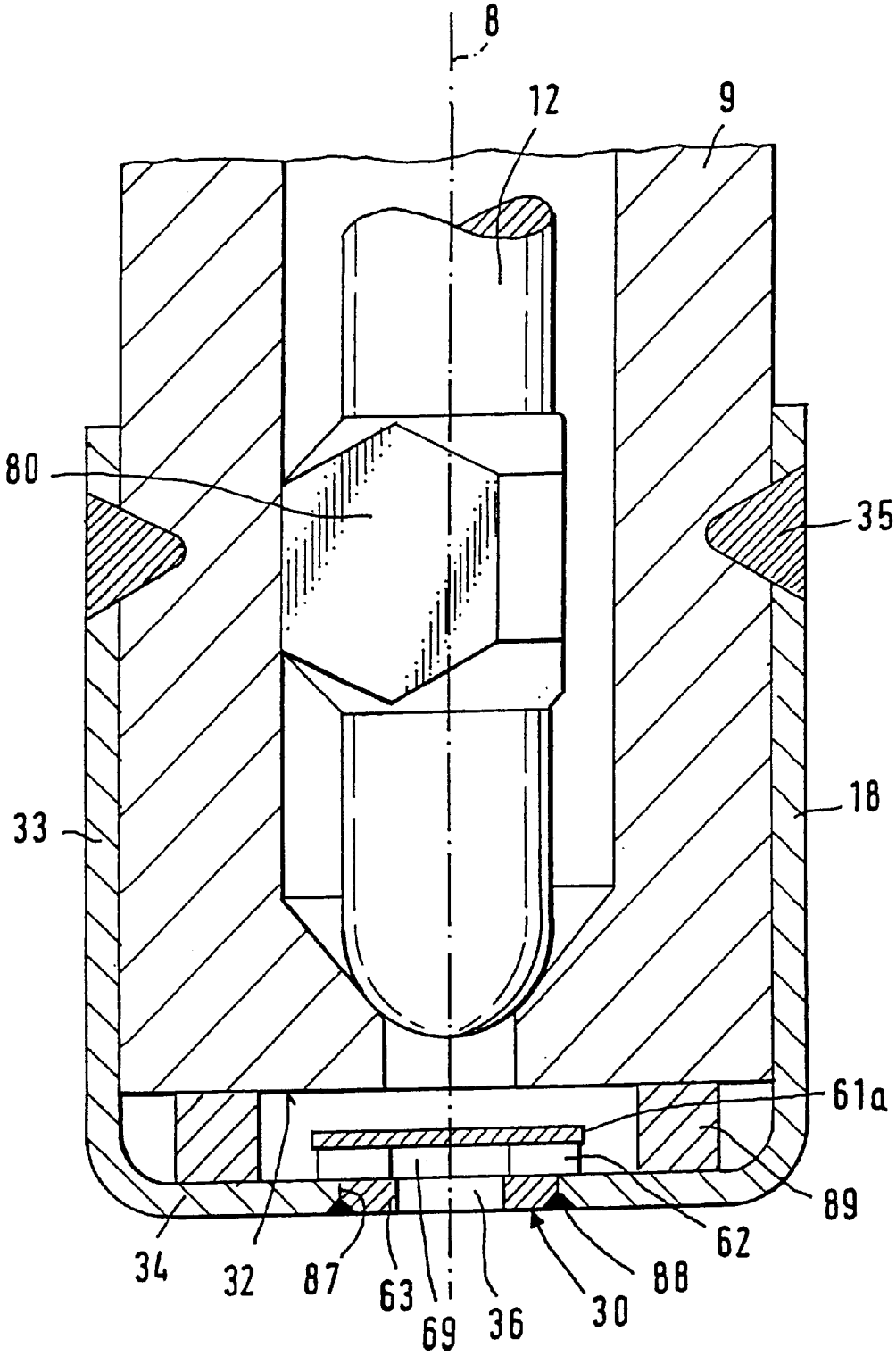
FIG. 8 shows a fifth embodiment of a downstream end of a fuel injection valve according to the present invention.

According to the embodiment illustrated in FIG. 8, swirl disk 30 is integrated directly into holding element 18. Cup-shaped holding element 18, which is made of sheet metal and can be formed, for example, by deep-drawing, has a larger hole 87 in its base section 34, instead of discharge opening 36, for holding swirl disk 30. Swirl disk 30 is again designed in three layers, but this time with an upper cover layer 61*a*, a middle swirling layer 62, and a lower base layer 63, eliminating the upper spacing layer. Base layer 63 is inserted into base section 34 of holding element 18 and attached to the latter, for example, by a ring-shaped circumferential weld seam 88. Weld seam 88 is not subjected to any high stresses, because the larger design of upper layers 61*a* and 62 of swirl disk 30 allows the latter to be supported on the inner limit side of base section 34 when the internal valve pressure is applied. A spacing element 89, which is designed, for example, in the shape of a ring, is inserted between lower end 32 of valve seat body 9 and base section 34 and establishes a desired distance between swirl disk 30 and valve seat body 9, so that fuel can always be supplied to swirl disk 30. Discharge opening 36 of the valve is formed directly by the discharge opening in base layer 63 of swirl disk 30.

In addition to especially preferred swirl disks 30 described in great detail above, other embodiments of atomizer disks can also be used, such as disks which have inlet and discharge openings that are offset from one another, thus producing an S-shaped flow pattern, and can be produced in the form of multilayer electroplated metal disks.

What is claimed is:

1. A fuel injection valve for a fuel injection system of an internal combustion engine, the fuel injection valve directly injecting fuel into a combustion chamber of the internal combustion engine, comprising:

a longitudinal valve axis;

a valve seat body;

a stationary valve seat situated on the valve seat body for opening and closing the fuel injection valve;

a movable valve part interacting with the stationary valve seat;

at least one actuator for operating the movable valve part; and a multilayer atomizer disk situated downstream from the stationary valve seat, each layer of a plurality of layers of the atomizer disk being built up by electrodeposition so that the layers firmly adhere to each other, the atomizer disk including an upper layer facing the valve seat body, the upper layer having a plurality of material areas resting against a lower end of the valve seat body, the material areas being separated from each other by opening structures, the opening structures extending at least partially in a radial direction in the upper layer.

2. The fuel injection valve according to claim 1, wherein the atomizer disk is a swirl disk, the swirl disk including a swirl chamber and at least two swirl channels, the at least two swirl channels emptying into the swirl chamber.

3. The fuel injection valve according to claim 1, wherein the atomizer disk further includes a lower layer, the lower layer facing away from the valve seat body and resting against a holding element.

4. The fuel injection valve according to claim 3, wherein the holding element is cup-shaped, the holding element including a circumferential jacket section and a base section, the lower layer resting on an inner limit side of the base section.

5. The fuel injection valve according to claim 4, wherein the atomizer disk is clamped between the valve seat body and the base section of the holding element.

6. The fuel injection valve according to claim 4, wherein one layer of the atomizer disk centers the atomizer disk within the circumferential jacket section of the holding element.

7. The fuel injection valve according to claim 4, wherein the circumferential jacket section is permanently joined to the valve seat body via a welded seam.

8. The fuel injection valve according to claim 4, wherein the atomizer disk is situated in an indentation, the indentation being situated on the inner limit side of the base section.

9. The fuel injection valve according to claim 4, further comprising:

a discharge opening situated in the base section of the holding element, the discharge opening being one of parallel to the longitudinal valve axis and inclined at an angle in relation to the longitudinal valve axis.

10. The fuel injection valve according to claim 1, wherein the atomizer disk is situated in an indentation, the indentation being situated at the lower end of the valve seat body.

* * * * *